US010746437B2

(12) United States Patent
Giaretta et al.

(10) Patent No.: US 10,746,437 B2
(45) Date of Patent: Aug. 18, 2020

(54) FLUID FUEL HEATER TO HEAT AIR AND A METHOD FOR OPERATING SAID HEATER

(71) Applicant: Dantherm S.p.A., Pastrengo, Verona (IT)

(72) Inventors: Enzo Giaretta, Pastrengo (IT); Stefano Marchiotto, Pastrengo (IT); Giuseppe Toniato, Pastrengo (IT); Stefano Verani, Pastrengo (IT)

(73) Assignee: Dantherm S.p.A., Pastrengo (IT)

( * ) Notice: Subject to any disclaimer, the term of this patent is extended or adjusted under 35 U.S.C. 154(b) by 27 days.

(21) Appl. No.: 16/057,524

(22) Filed: Aug. 7, 2018

(65) Prior Publication Data

US 2018/0347857 A1 Dec. 6, 2018

Related U.S. Application Data

(62) Division of application No. 14/552,175, filed on Nov. 24, 2014, now Pat. No. 10,066,854.

(30) Foreign Application Priority Data

Oct. 16, 2014 (IT) ..... MI2014A1796

(51) Int. Cl.

| | |
|---|---|
| ***F23N 1/02*** | (2006.01) |
| ***F24H 9/20*** | (2006.01) |
| ***F23N 3/08*** | (2006.01) |
| ***F24H 3/06*** | (2006.01) |
| ***F24H 3/08*** | (2006.01) |

(Continued)

(52) U.S. Cl.

CPC ..... *F24H 9/2085* (2013.01); *F23N 3/082* (2013.01); *F24H 3/065* (2013.01); *F24H 3/08* (2013.01); *F24H 9/0068* (2013.01); *F24H 9/0094* (2013.01); *F23N 2225/04* (2020.01); *F23N 2225/14* (2020.01); *F23N 2233/08* (2020.01); *F24H 3/0417* (2013.01)

(58) Field of Classification Search

CPC .. F23N 2025/14; F23N 2025/13; F23N 5/003; F23N 1/04

USPC ..... 431/38, 61, 12, 89, 90; 126/104 A, 126/104 R, 90 R, 99 R; 137/6; 239/8

See application file for complete search history.

(56) References Cited

U.S. PATENT DOCUMENTS

| | | | | |
|---|---|---|---|---|
| 4,998,878 | A * | 3/1991 | Gruber | F23K 5/04 126/110 B |
| 2002/0129609 | A1 | 9/2002 | Pont | |
| 2003/0084896 | A1 | 5/2003 | Gierula | |

(Continued)

*Primary Examiner* — Vivek K Shirsat

(74) *Attorney, Agent, or Firm* — Blank Rome LLP

(57) ABSTRACT

A movable fluid fuel heater to heat air and to introduce it into an environment to be heated. The heater includes a flow rate variator device for varying the flow rate of oxidizing air introduced in the combustion chamber by a forced ventilation device between a minimum flow rate value and a maximum flow rate value. The heater also includes a reference device comprising a plurality of reference values of a parameter representative of the pressure and a plurality of reference temperature values of the environmental air upstream of the combustion chamber. The reference device is configured to suggest an optimal setting value to set the flow rate variator device, at each pair of values formed by a value of the plurality of reference values of a parameter representative of the pressure and a value of the plurality of reference temperature values.

8 Claims, 5 Drawing Sheets

(51) Int. Cl.
*F24H 9/00* (2006.01)
*F24H 3/04* (2006.01)

(56) References Cited

U.S. PATENT DOCUMENTS

| | | | |
|---|---|---|---|
| 2009/0111065 | A1 | 4/2009 | Tompkins |
| 2014/0117977 | A1 | 5/2014 | Celidonia |

* cited by examiner

FLUID FUEL HEATER TO HEAT AIR AND A METHOD FOR OPERATING SAID HEATER

CROSS REFERENCE TO RELATED APPLICATIONS

This is a divisional of U.S. patent application Ser. No. 14/552,175, filed Nov. 24, 2014, which claims priority to Italian Patent Application No. MI2014A001796, filed Oct. 16, 2014, the entire disclosures of which are incorporated by reference herein in their entireties.

BACKGROUND OF THE INVENTION

1. Field of the Invention

The present invention relates to a fluid fuel heater, particularly a liquid fuel heater, to heat air and to introduce it into an environment to be heated. Particularly, it is a movable heater particularly having a high heating power, for example, with a cart, suitable to be easily transported and temporarily placed in different working places, sometimes at environmental and atmospheric conditions even very different from one another, for example in a construction site at a high height or even at sea level, in a mine, in an industrial warehouse. According to another aspect, the invention relates to a method to operate such heater.

2. Description of the Related Art

Environmental air fuel heaters are known, which are suitable to generate a hot air flow by the combustion of a fuel and to introduce the heated air into the environment. Sometimes such heaters have a high heating power and produce a considerable flow of hot air. Furthermore, sometimes such known heaters are mounted on a wheeled cart, and the cart can be dragged by a transport means.

A known heater of this type comprises a tubular combustion chamber, generally arranged with a horizontal axis, a liquid fuel supply duct that ends with a nebulizer nozzle, suitable to nebulize the fuel in the combustion chamber, and a forced ventilation device that inputs oxidizing air into the combustion chamber in which the nebulized fuel is dispensed. The combustion is initiated by an ignition device which generates sparkles.

As it is known, the combustion process, in order to take place in an optimal manner, has to be carried out according to a suitable stoichiometric ratio between fuel amount and air amount, i.e., the nebulized fuel and the air have to result in a stoichiometric mixture, i.e., according to a wee-determined stoichiometric ratio.

When the amount of one of the two components of the mixture varies with respect to the amount of the other one, with reference to the stoichiometric ratio, the combustion quality is affected thereby.

For example, if the air amount is less than that provided for in the stoichiometric ratio, the combustion can be incomplete and originate an efficiency loss of the combustion with emission of fumes of non-combusted carbon, generally having a characteristic black appearance. Under certain conditions, fumes with high Bacharach levels can be generated.

In other situations, if the amount of oxidizing air falls below a predetermined threshold with respect to the fuel amount, it can happen that the combustion does not even start.

Therefore, the known heaters of this type have a drawback of having a combustion and operation quality that is strongly affected by the atmospheric conditions, and particularly by the air density.

Particularly, a known heater of this type, which is adjusted for an optimal operation at the sea level, if is transported at a high altitude, for example to heat an industrial warehouse or a construction site at 4000 meters above the sea level, will undoubtedly produce a high amount of fumes, or it will not even able to start the combustion due to the reasons explained above, due to the decrease of the air density.

Sometimes, the known heaters provide for a mantle which externally wraps the combustion chamber forming an interspace in which an environmental cooling air flow is introduced, which cools the combustion chamber and concomitantly heats by contact therewith, to then exit the heater, thus heating the environment.

The decrease of the air density when the heater, adjusted in order to operate in an optimal manner at sea level, is brought to a high altitude, very adversely affects also the combustion chamber cooling efficiency by the air flow in the external interspace.

In fact, the lesser air density allows a less heat to be removed from the combustion chamber, therefore it produces at the same time an overheating of the combustion chamber and an overheating of the mantle. This drawback is unacceptable both because it can result in an irreversible damage of the heater, and because it is dangerous due to the risk of burns of a user who inadvertently touches the mantle.

Therefore the air density changing adversely affects not only the combustion quality per se, but also the heat subtraction from the cooling air.

In order to avoid this worsening of the combustion due to the increase in the temperature of the combustion chamber, a fuel flow rate reduction would be needed. The known liquid fuel heaters do not allow this flow rate decrease, since they use a nebulization nozzle, which nebulizes only above a predetermined nebulization pressure threshold of the pumped fuel, i.e., beyond a determined minimum fuel flow rate. In other terms, it is not possible to reduce the fuel flow rate below a minimum fuel flow rate, because no nebulization would occur below it.

A solution, which is anyhow disadvantageous, could be to replace the nozzle with another one having different characteristics, each time the air density changes.

However, replacing the nozzle with another one having different characteristics each time the heater is moved from a site to another one with different environmental characteristics, particularly with a less pervious nozzle to reduce the dispensed fuel amount, would involve the further drawback of requiring much working time, and especially qualified personnel. During the replacement operations, the heater should be turned off and this would involve a stop of the construction site operations.

On the contrary, the need is felt that such heaters are capable of operate in an optimal and reliable manner without the intervention of qualified personnel, since they are intended to operate under extreme environmental conditions, sometimes in places which are very far from inhabited sites or technical assistance centers.

Therefore, the need is felt to provide a movable, or transportable fluid fuel air heater that can be adapted to environmental conditions, particularly at altitudes and external temperatures that are very different from one another, in a quick and inexpensive manner and avoiding to require the intervention of qualified personnel.

SUMMARY OF THE INVENTION

It is an object of the present invention to devise and provide a fluid fuel heater to heat air and to introduce it into an environment to be heated that allows meeting the above-mentioned needs and to at least partially obviate the drawbacks set forth above with reference to the prior art.

Particularly, object of the present invention is to provide a fluid fuel heater that is able to be adapted to very different environmental conditions, particularly at altitudes and environmental temperatures that are very different from one another, in a quick and inexpensive manner and avoiding the need for the intervention of qualified personnel.

A further object of the present invention is to provide a fluid or liquid fuel air heater, capable of ensuring a high reliability and operational continuity also following high changes in the altitude and external temperature, and under extreme environmental conditions.

Another object of the present invention is to provide a fluid fuel air heater capable of ensuring a long operating life, avoiding the need for maintenance interventions, or a frequent replacement of thermally stressed parts.

A further object of the present invention is to ensure the safety of use of the heater by the operators, avoiding the risk of burns thereof when in contact with the mantle, also when the environmental conditions change.

Another object of the present invention is to provide a heater capable of avoiding the generation of black fumes with high levels of Bacharach, also in the case where the environmental conditions change considerably.

Another object of the present invention is to provide a heater capable of keeping a high thermal yield, also following high changes of external environmental conditions.

A further object of the present invention is to provide an environmental air heater, the operation of which can be controlled continuously by an operator.

Another object of the present invention is to provide a method to operate such heater, so as to achieve the above-mentioned objects.

These and further objects are achieved by a fluid fuel heater to heat air and to introduce it into an environment to be heated as described herein. According to another aspect of the present invention, the above-mentioned objects and advantages are achieved by a method to operate a fluid fuel heater as described and claimed herein.

The solution proposed by the present invention meets the above-mentioned needs and solves the above-mentioned technical problem, allowing to change the flow rate of oxidizing air introduced into the combustion chamber, between a minimum flow rate value and a maximum flow rate value in accordance with a suggested value of optimal setting provided by a reference device associated with the heater, as a function of a pressure value, or a value representative of the pressure, and of a temperature value of the air upstream of the combustion chamber.

Particularly, with the aid of a reference table which matches, to pairs of preset temperature and pressure reference values, corresponding optimal setting values for a device for variating the oxidizing air flow rate in the combustion chamber, it will be possible to identify on such table, the specific pair of preset reference values of pressure and temperature that is nearest to that measured for the air entering the combustion chamber, and consequently easily identify the corresponding optimal setting value for the variator device. Therefore, it will be sufficient to act on the variator device of oxidizing air flow rate to provide the optimal flow rate of oxidizing air as the air density changes.

Particularly, this adjusting operation of the flow rate variator can be performed manually, by setting a flow rate value corresponding to the optimal setting value. In this manner, a direct visual control by an operator is ensured, as required by some safety regulations.

Advantageously, the provision of a second flow rate variator device to vary the flow rate of the cooling air flow in an interspace formed between the combustion chamber and a mantle laterally wrapping the combustion chamber, as a function of a pressure and air temperature value measured upstream of the combustion chamber, allows adjusting the amount of heat subtracted from the combustion chamber by means of the convective flow of the cooling air as the air density changes.

Furthermore, advantageously, the provision of providing at least two separate dispensing nozzles wherein a corresponding opening/closure valve is associated at least to one of them to open or close the passing of fuel through such at least two dispensing nozzles in a selective manner, allows adjusting the overall flow rate of fluid fuel to the combustion chamber based on the air pressure and temperature as measured upstream of the combustion chamber.

This allows overcoming the problem of the worsening of the combustion quality due to the decrease of the air density. It also allows improving the heat subtraction efficiency from the combustion chamber, by the cooling air that flows between the combustion chamber and mantle, avoiding the overheating of the combustion chamber and also of the mantle.

BRIEF DESCRIPTION OF THE DRAWINGS

Different embodiments of the invention will be now described herein by implementation examples set forth for illustrative purpose only and in a non-limiting form, with reference particularly to the annexed figures, in which.

DETAILED DESCRIPTION OF THE PREFERRED EMBODIMENTS

Figure 1:
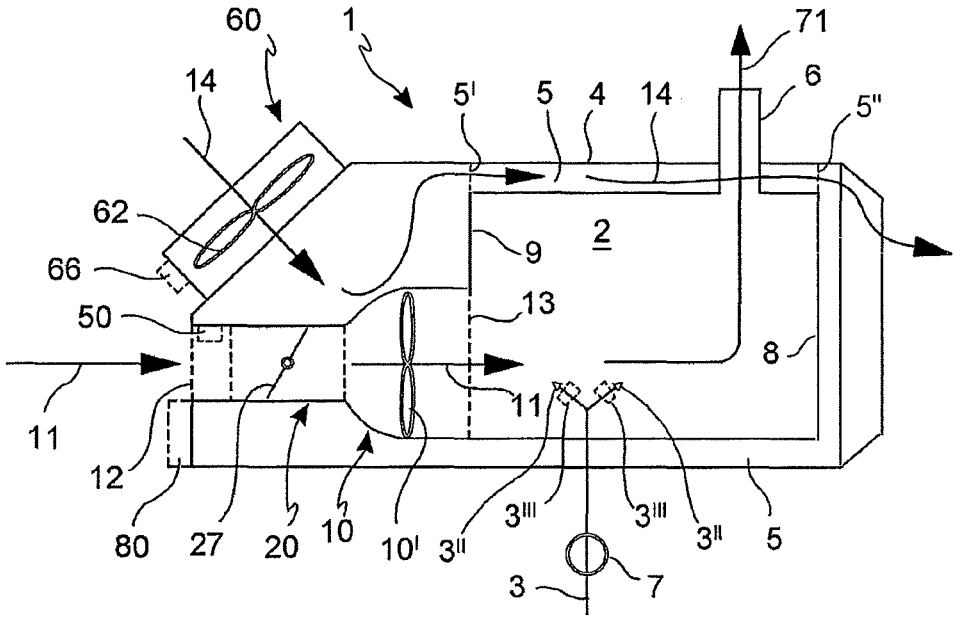
FIG. 1 schematically illustrates a sectional simplified view of a heater according to the invention.
Figure 2:
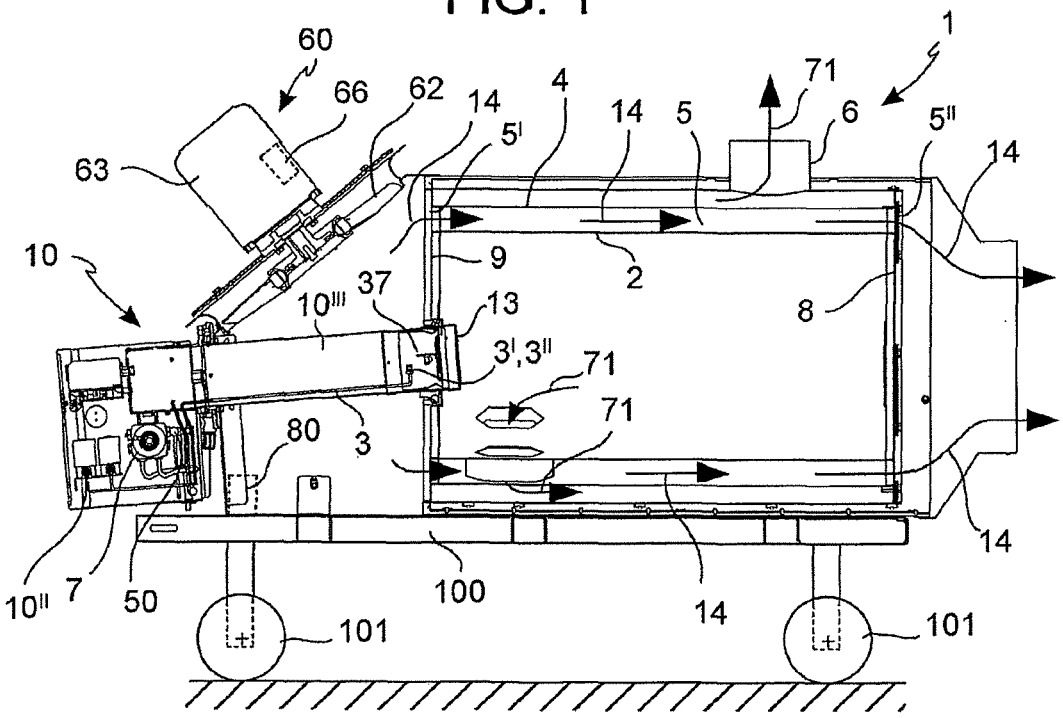
FIG. 2 schematically illustrates another sectional simplified view of a heater according to the invention.
Figure 3:
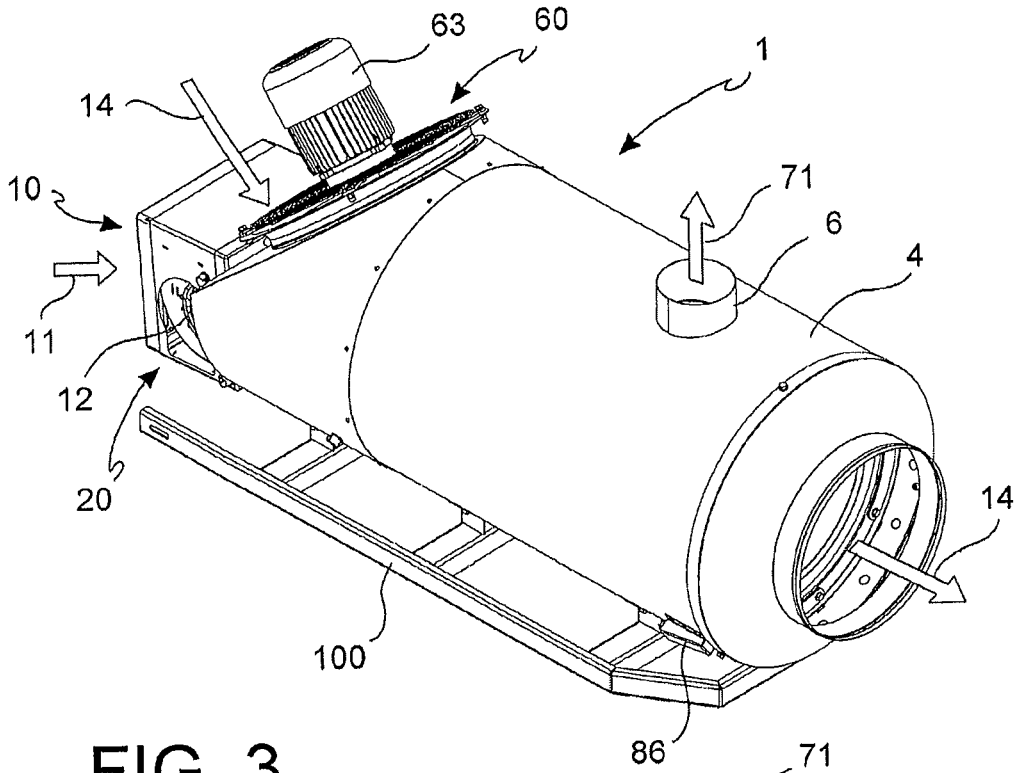
FIGS. 3 and 4 schematically show two perspective views, of a heater as in FIG. 1 or 2.
Figure 4:
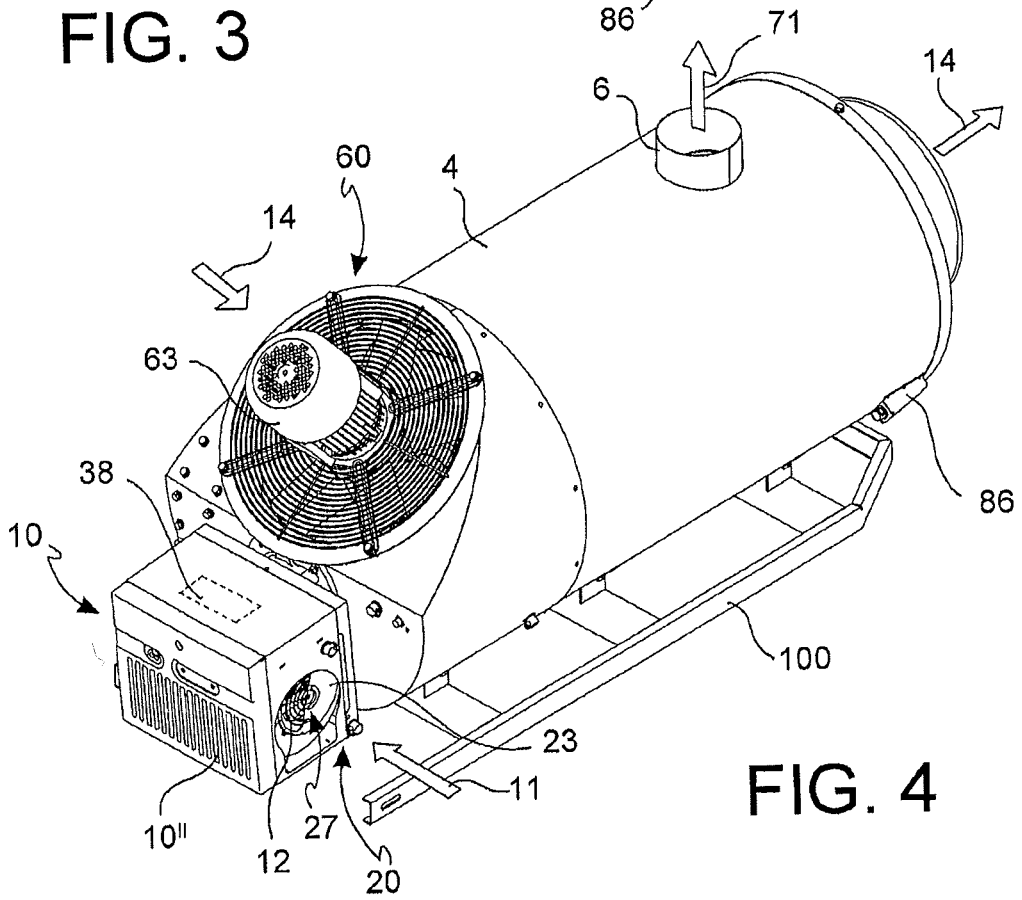
Figure 5:
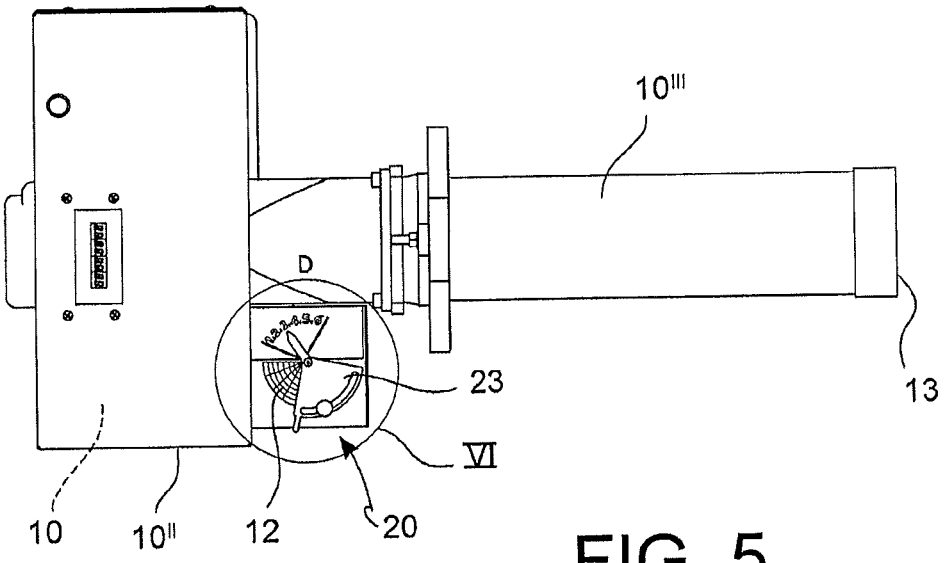
FIG. 5 illustrates a top view of a forced ventilation device with flow rate variator of a manual type used in the heater of the preceding figures.

By the term "environmental pressure" or "environment pressure" is meant the pressure of the air in the location where the heater is used, particularly upstream of the combustion chamber.

By the term "environmental temperature" or "environment temperature" is meant the temperature of the air in the location where the heater is used, particularly upstream of the combustion chamber.

With reference to the figures, a fluid fuel, particularly a liquid fuel heater, according to the invention, for heating air and to introduce it into an environment to be heated, is generally indicated with the reference 1.

The fluid fuel heater 1 according to the invention comprises a combustion chamber 2, for example a tubular cylindrical chamber, and a supply duct 3 for a fluid fuel arranged to dispense said fluid fuel in said combustion chamber 2.

The combustion chamber 2 comprises an input opening for oxidizing air 11 to supply the combustion, preferably in a first end wall 9 of the combustion chamber 2.

In accordance with an embodiment, the heater 1 comprises an ignition device 37 suitable to start the combustion in the combustion chamber 2.

The heater 1 comprises a forced ventilation device 10, or first forced ventilation device 10, arranged to collect oxidizing air 11 from the exterior of the heater 1 through a suctioning opening 12, and to introduce it in the combustion chamber 2 through said input opening 13, in which said oxidizing air 11 can react with said fluid fuel to carry out a combustion.

Furthermore, the heater 1 comprises a flow rate variator device 20, or first flow rate variator device 20, configured to vary the oxidizing air flow rate introduced in the combustion chamber 2 by said first forced ventilation device 10, between a minimum flow rate value and a maximum flow rate value, as a function of a pressure and temperature value of the air measured upstream of the combustion chamber 2.

In this manner, it is possible to operate on the first oxidizing air flow rate variator device 20 so as to adapt such flow rate to the air density change, following, for example, the transfer of the heater from an altitude to another, higher one. Therefore it is possible to act on the first flow rate variator device 20 to adjust the mixture ratio between fuel and oxidizing air so that it is substantially equal to the stoichiometric ratio, in order to optimize the combustion also as the external air density conditions change.

According to an embodiment, the flow rate variator device 20 comprises an occlusion member 27, for example a shutter, or a throttle body, which is movable between a minimum flow section value corresponding to said minimum flow rate value and maximum flow section value corresponding to said maximum flow rate value.

For example, the occlusion member 27 is a plate-like member 23, for example made of a metal sheet.

For example, the occlusion member 27 is rotatably constrained to the heater about a rotational axis 23', and it is arranged to occlude the oxidizing air suctioning opening 12 in a manner proportional to the angular position of said occlusion member 27 about the rotational axis 23'. In other terms, the occlusion member is movable angularly between an angular position of minimum flow section and an angular position of maximum flow section. For example, the occlusion member 27 is configured as a planar circular sector having a vertex hinged about said rotational axis 23'.

According to an embodiment, the first flow rate variator device 20 comprises an indicator device 24 suitable to indicate a set value 25 of said flow rate variator 20.

Figure 6:
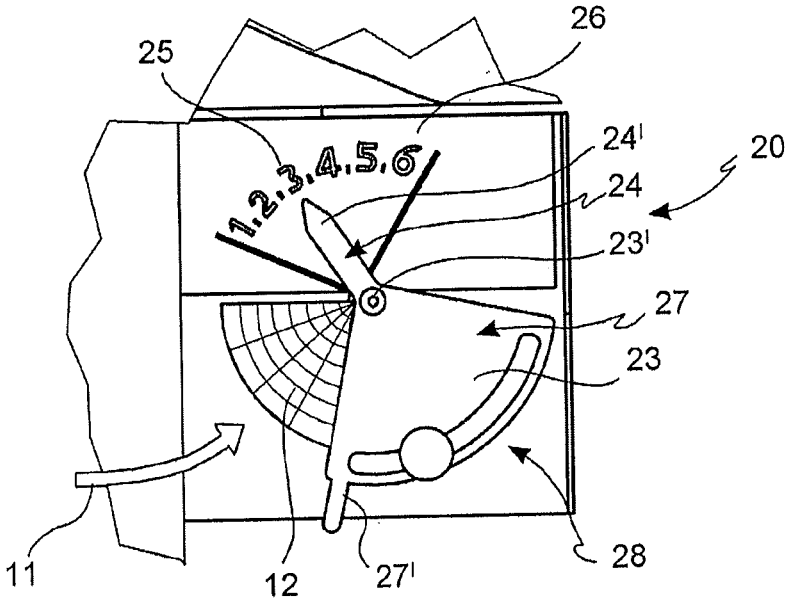
FIG. 6 shows a detail of the flow rate variator of FIG. 5.
Figure 7:
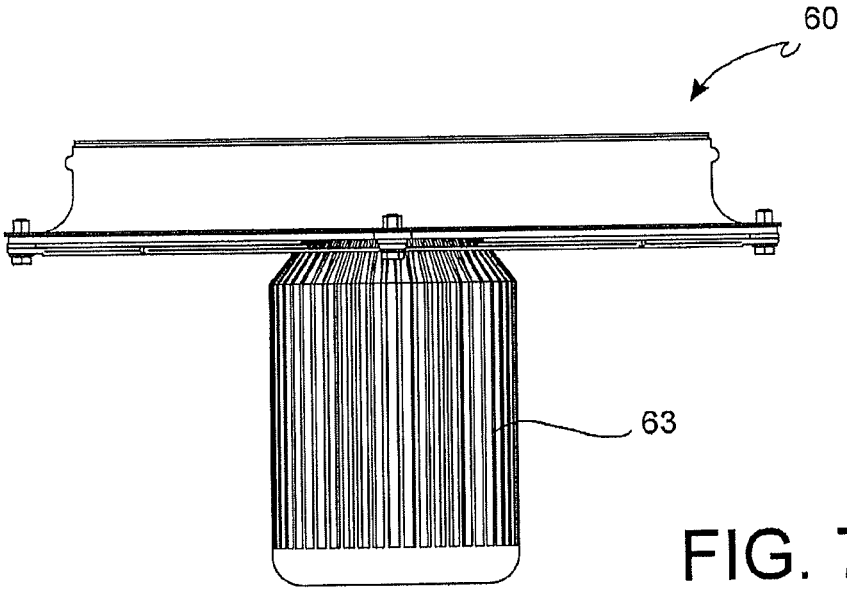
FIGS. 7 and 8 show a side view and a top view, respectively, of a second forced ventilation device with a manual flow rate variator, used in the heater of the preceding figures.
Figure 8:
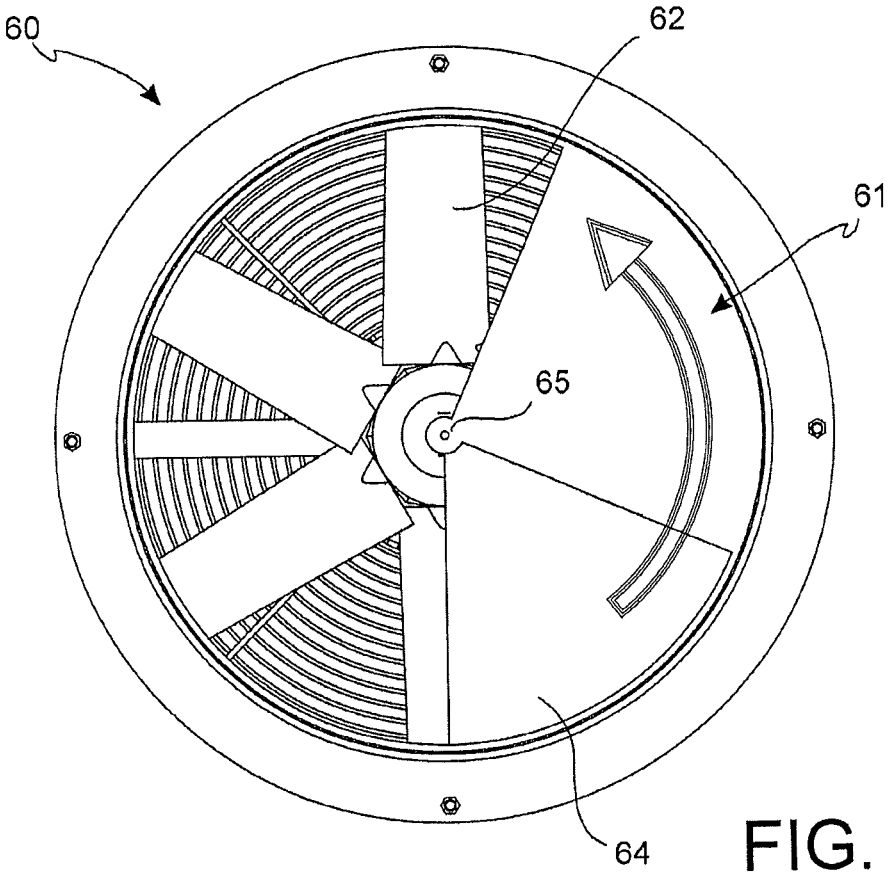

According to an embodiment, the indicator device 24 comprises a reference scale 26 and a pointer member 24' indicating on said reference scale 26 said set value 25, as shown, for example, in FIG. 6.

In accordance with an embodiment, the first flow rate variator device 20 comprises an actuation device 28 to move such occlusion member 27 in a position corresponding to said set value 25 corresponding to a desired oxidizing air flow rate value.

In accordance with an embodiment, the actuation device 28 is of the manual type, for example, the actuation device is a projection 27' of said occlusion member, manually displaceable by an operator.

According to an embodiment, the first actuation device 28 is of the motorized type, for example, it comprises a rotary actuator mounted to bring in rotation the occlusion member 27 between a maximum oxidizing air flow rate position and a minimum oxidizing air flow rate position, for example, said actuation device 28 is an electric motor.

According to an embodiment, the first flow rate variator device 20 comprises an occlusion member position sensor 27.

In accordance with an embodiment, the occlusion member 27 is slidably connected with respect to the heater.

Although the indicator device 24 described above is of the mechanical, or analogical type, according to an embodiment of the invention, the indicator device 24 can be of the electronic, or digital type, and it can comprise an electronic display which displays, for example, a set value of the flow rate of the flow of oxidizing air entering the combustion chamber 2.

In accordance with an embodiment, the first flow rate variator device 20 is arranged upstream of the first forced ventilation device 10, in the advancement direction of the oxidizing air from the external environment towards the interior of the combustion chamber.

In accordance with an embodiment, the first forced ventilation device 10 comprises a fan 10' brought in rotation by a rotary motor, for example, an electric motor.

In accordance with an embodiment, the first flow rate variator device 20 comprises a speed control of said rotary motor suitable to control the number of rotations of the motor between a minimum value of speed corresponding to a minimum flow rate value of the oxidizing air flow and a maximum value of speed corresponding to a maximum flow rate value of the oxidizing air flow.

In accordance with an embodiment, the first forced ventilation device 10 comprises a containment box 10" containing the fan 10' and the rotary motor connected thereto, such containment box 10" being fluidically connected with the suctioning opening 12 and with the input opening 13.

The first forced ventilation device 10 can further comprise an oxidizing air input tube 10''' which fluidically connects the containment box 10" with the input opening 13. In other terms, the input tube 10''', for example cylindrical, conveys the oxidizing air from the first ventilation device up to the interior of the combustion chamber 2.

In accordance with an embodiment, the heater 1 comprises a reference device 40, or first reference device 40, to suggest an optimal setting value 41 to actuate the first flow rate variator device 20 as a function of a reference value of a parameter representative of the pressure 42 and of a reference value of the temperature 43 of the environmental air upstream of the combustion chamber 2.

Said first reference device comprises a plurality of reference values of a parameter representative of the pressure 42, and a plurality of reference temperature values 43, said first reference device associating to each pair of values formed by a value of said plurality of reference values of a parameter representative of the pressure 42, and by a value of said plurality of reference temperature values 43, a corresponding optimal setting value 41.

Particularly, the optimal value 41 is determined so as to make a suitable amount of oxidizing air flow into the combustion chamber 2, particularly to operate the heater 1 in an optimal manner.

In accordance with an embodiment, such first reference device is a reference matrix, particularly a reference table 40.

In accordance with an embodiment, such reference table 40 is represented, or printed, on a rigid support or on an adhesive support, and it is associated to the heater, for example, it is applied in the proximity of the flow rate variator device 20, or, for example, in the proximity of the actuation device 27' or the indicator device 24, so as to suggest to an operator the proper setting value.

Figure 9:
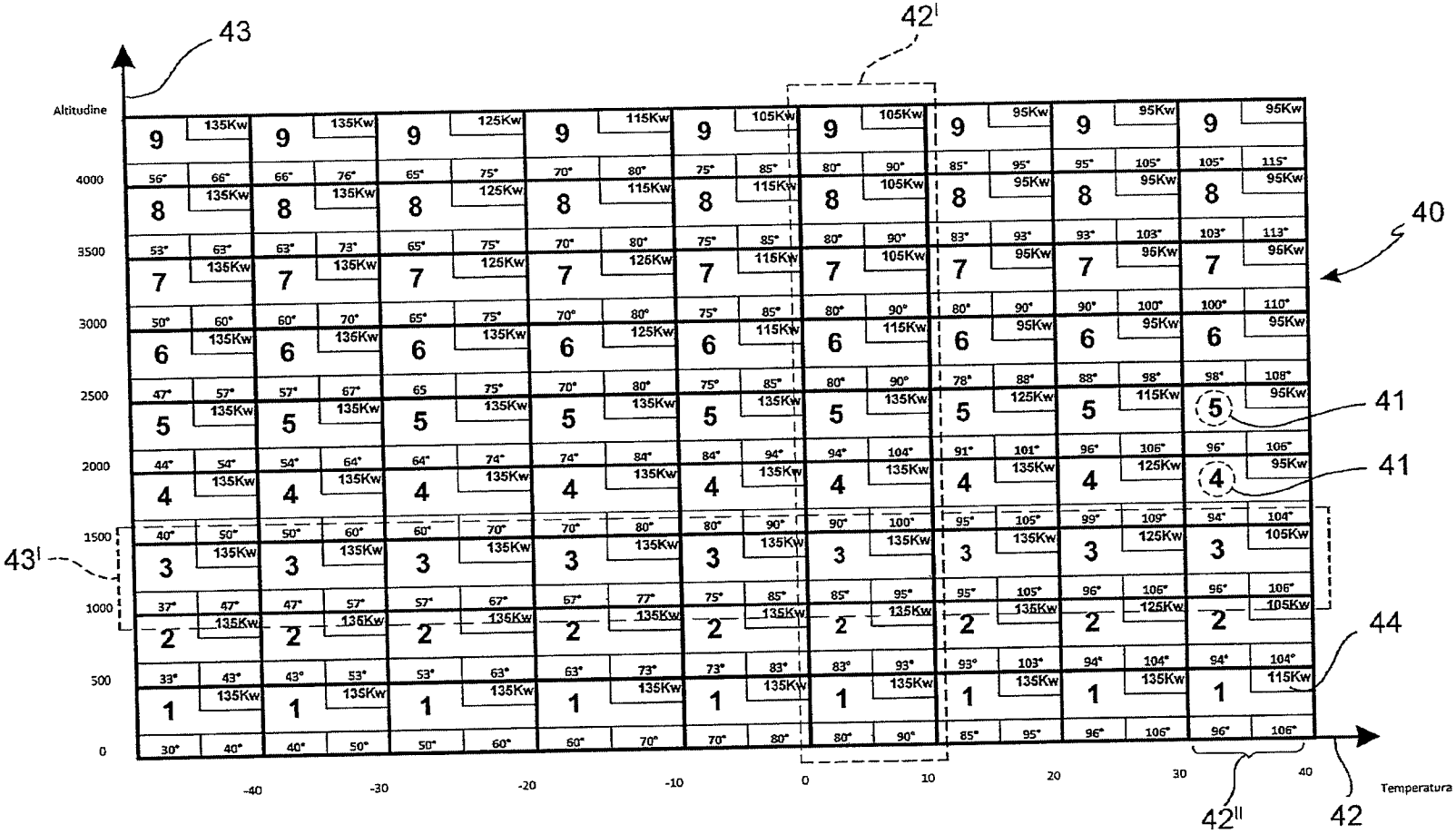
FIG. 9 shows an example of reference table that matches a setting value for the first flow rate variator as a function of the temperature and pressure measured upstream of the combustion chamber.

A possible example of reference table 40 is provided only as a non-limiting example and for illustrative purpose only, in FIG. 9.

This example of reference table is structured in the form of a matrix, in which each column 42' represents a reference temperature of the oxidizing air upstream of the combustion chamber, or environmental air.

Furthermore, in the matrix of FIG. 9, each row 43' represents a reference altitude value. Such altitude value is a value representative of the air pressure, hence of the oxidizing air, at that specific altitude. In such table, in fact, it is believed that a specific air pressure corresponds to a specific height, or altitude.

In alternative to the altitude or height, any other parameter representative of the environmental air pressure in the location of use of the heater can be used, for example, the geographic coordinates of the location where the heater is used at which a geographic height or altitude is univocally associated, hence a specific pressure of the air at that height. Such geographic coordinates could be easily detected, for example by a GPS device.

A direct measurement of the air pressure in the location of use of the heater could provide a more precise value than that provided by another parameter representative of the pressure.

In accordance with an embodiment, the reference table 40 matches to each pair formed by a reference temperature value 42 and by a reference value of a parameter representative of the pressure 43 of the air upstream of the combustion chamber 2, further additional setting values 44 to control or adjust further devices associated to the heater, for example a value of required combustion thermal power, or a fuel flow rate value, or a number of fuel dispensing nozzles to be actuated concomitantly, particularly to operate the heater 1 in an optimal manner.

The reference table 40 can, further, associate to each above-mentioned pair of reference values of the air upstream of the combustion chamber 2, also parameter in output from the heater 1, for example a range of obtainable temperatures of the cooling air exiting the annular interspace 5, which will be described herein below. An example of a representation of an output temperature range is illustrated in FIG. 9 with the reference number 42".

Particularly, in the example illustrated by the table 40 of FIG. 9, such range is indicated in Fahrenheit degrees, but it could be represented in Celsius degrees, or in any other temperature measurement units.

In the example of FIG. 9, the matrix is formed by 9 columns and 9 rows only by way of non-limiting example, therefore the above-mentioned matrix can be implemented with any number of rows and columns.

Similarly, the rows and columns can be inverted, for example so that the columns include values representative of the environmental pressure and the rows include values of environmental temperature.

The parameter representative of the air pressure can be selected from many parameters, for example, the air pressure measured upstream of the combustion chamber, the altitude in the location of use, the geographic coordinates.

The air pressure and temperature determine together the air density. Therefore, according to an embodiment of said reference table 40, each pair formed by a reference temperature value 42 and a reference value of a parameter representative of the pressure 43 of the air upstream of the combustion chamber 2, can be replaced by a reference value of air density upstream of the combustion chamber.

In such a case, the reference table 40 associates to each reference value of air density upstream of the combustion chamber 2, a corresponding setting value 41 according to which the flow rate variator 20 has to be set to make a suitable amount of oxidizing air flow into the combustion chamber 2, particularly to operate the heater 1 in an optimal manner. Therefore the table 40 can be formed, for example, also by a single row, or a single column.

In such a case, the heater can comprise a device measuring the air density upstream of the combustion chamber 2.

In accordance with an embodiment, the heater 1 comprises a measurement device 50 suitable to measure the temperature and pressure of the environmental air upstream of the combustion chamber 2. Particularly such measurement device comprises a temperature sensor and a pressure sensor.

According to an embodiment, the measurement device comprises a display unit 38 to display a measured value of said pressure and a measured value of said temperature.

According to an embodiment, the measurement device 50 is configured to provide in output an electric signal representative of a measured value of said pressure and a measured value of said temperature.

From an operative viewpoint, in accordance with an embodiment of the present invention, the heater 1 according to the invention is operable in a manual manner.

The user will be able to measure a temperature value and a value of a parameter representative of the air pressure upstream of the combustion chamber 2 obtaining a measured value of temperature and a measured value of such parameter representative of the pressure. For example, the operator will measure the temperature and pressure of the air upstream of the combustion chamber.

In such a case the user can compare a measured value of a parameter representative of the pressure, for example, the pressure of the air or the altitude, with the reference values of parameter indicative of the pressure 43, particularly reading them from the reference device, and selecting the pressure reference value that is the nearest to the measured value of such parameter representative of the pressure.

Similarly, the user can compare a measured temperature value with the reference temperature values 42 of the reference device 40 and selecting the reference temperature value that is the nearest to the measured temperature value.

Consequently, the user can identify by the reference device 40 an optimal setting value 41 corresponding to said reference temperature value 42 that is the nearest to the measured value and to said reference value of a parameter representative of the pressure 43 that is the nearest to the measured value.

Therefore, the user can actuate said flow rate variator device 20, particularly said actuation device 28, according to said optimal setting value 41.

In this manner, the user can manually adjust the heater 1 based on a suggestion provided by the first reference device and directly and visually verify its proper operation, as required by some safety regulations.

For example, it will be possible to initially adjust the first flow rate variator device 20 so that to a value intermediate between a minimum use altitude, or maximum air pressure, and a maximum use altitude, or minimum air pressure, the first flow rate variator device 20 is set to provide an intermediate oxidizing air flow rate between the minimum flow rate and the maximum flow rate. In this manner, as the altitude or the temperature decreases, and consequently as the air density increases, it will be possible to compensate the effect by reducing the air flow rate by adjusting, or actuating, the first variator device 20.

Vice versa, as the altitude or the temperature increases, and consequently, as the air density decreases, it will be possible to compensate the effect by increasing the air flow rate 11 by adjusting, or by actuating, the first variator device 20.

In accordance with an embodiment, the heater 1 comprises a control unit 80, for example an electronic control unit, connected with said measurement device to receive said electric signal, and connected with said first flow rate variator device 20, particularly with said actuation 28, to automatically actuate said first flow rate variator device 20 as a function of the value of the parameter representative of the pressure and of the temperature value of the air measured upstream of the combustion chamber 2.

In other terms, in accordance with an embodiment, the control unit 80 is programmed for:

receiving from said measuring device 50 an electric signal representative of a measured value of said parameter representative of the pressure and of a measured value of said temperature;

comparing said measured value of a parameter representative of the pressure, with the reference values of a parameter representative of the pressure 43 of said reference device 40, and selecting the reference value of the parameter representative of the pressure that is the nearest to the measured value of such parameter representative of the pressure 43;

comparing a measured temperature value with the reference temperature values 42 of said reference device 40 and selecting the reference temperature value that is the nearest to the measured temperature value;

identifying, by said reference device 40, an optimal setting value 41 corresponding to said selected reference temperature value 42 and to said selected reference value of said parameter representative of the pressure 43;

suggesting to a user said optimal setting value (41).

In accordance with an embodiment, the first reference device 40 comprises a memory unit associated to said control unit 80.

In accordance with an embodiment, the control unit 80 is configured to display said optimal setting value 41.

In this manner, the control unit 80 acts as a dynamic prompter, this meaning that it is configured to automatically suggest to a user the proper setting value to be set to the first flow rate variator device. Also in this case, the user can visually verify and control the proper operation of the heater.

In accordance with an embodiment, the control unit 80 is configured for providing in output an electric actuation signal suitable to actuate said flow rate variator device 20, particularly said actuation 28, according to said optimal setting value 41. In such a case, the adjustment of the heater according to the invention is completely automatic.

In accordance with an embodiment, the heater 1 comprises a mantle 4 that externally wraps the combustion chamber 2 forming an annular interspace 5 between the combustion chamber 2 and the mantle 4.

In accordance with an embodiment, the mantle 4 has a tubular cylindrical form, with a diameter that is larger than that of the combustion chamber 2, and it is arranged coaxially to the combustion chamber 2.

In accordance with an embodiment, the heater 1 comprises a second forced ventilation device 60 suitable to introduce a cooling air flow 14 into said interspace 5, so that said cooling air externally skims the combustion chamber 2 running along said interspace 5, subtracting heat to the combustion chamber 2 and concomitantly heating for heating the external environment downstream of the combustion chamber 2.

In accordance with an embodiment, the annular interspace 5 has an input opening 5' to receive the cooling air from the second forced ventilation device 60, and an output opening 5" to introduce the heated cooling air into the environment. For example, the input opening 5' is arranged upstream of the combustion chamber 2 and the output opening 5" is arranged downstream of the combustion chamber 2. Particularly, the input opening 5' is in the proximity of the first end wall 9 of the combustion chamber, the output opening 5" is in proximity of the second end wall 8 of the combustion chamber 2.

The heater 1 comprising both the combustion chamber 2 and the mantle 4 have separated air paths, i.e., the path of the oxidizing air 11 in the combustion chamber and the path of the cooling air 14 in the annular interspace 5 are mutually separated.

In such a case, the combustion chamber 2 comprises a chimney of output fumes 6 suitable to convey in output from the combustion chamber the fumes of the combustion 71, and the oxidizing air input opening 13 to supply the combustion.

Particularly, for example, the combustion chamber 2 can have a first end closed by a first wall 9 having said oxidizing air input opening 13, and a second end closed by a second wall 8.

In this manner, all the combustion fumes 71 can be conveyed, by a fume evacuation tube (not shown) connected to the chimney 6, outside of the environment to be heated and far from an environment to be heated in which there are people.

In accordance with an embodiment, the heater 1 comprises a second flow rate variator device 61 configured to vary the flow rate of said cooling air flow 14 in input to said interspace 5, between a minimum value and a maximum value, as a function of the above-mentioned pressure value and of the above-mentioned air temperature value measured upstream of the combustion chamber 2. As described above, the pressure value can be replaced by a value representative of the pressure, for example, the altitude, or even the geo-localization coordinates detected by a GPS device. Furthermore, as described above, the pair of a pressure value and a temperature value of the air upstream of the combustion chamber can be replaced by an air density value upstream of the combustion chamber.

In accordance with an embodiment, the second forced ventilation device 60 comprises a fan 62 and a rotary motor 63 to rotate the fan 62, and the second flow rate variator device 61 comprises a speed control 66 of said rotary motor 63 suitable to control the number of rotations of the motor 63 between a minimum value of rotations corresponding to a minimum cooling air flow rate value and a maximum value of rotations corresponding to a maximum cooling air flow rate value of In accordance with an embodiment, the second flow rate variator 61 comprises an occlusion member 64, for example, a shutter, or a throttle body, movable between a minimum flow section value corresponding to the minimum cooling air flow rate value and a value of maximum flow section corresponding to a maximum cooling air flow rate value.

For example, the occlusion member 64 is a plate-like member, for example made of a metal sheet.

For example, the occlusion member 64 is rotatably constrained to the heater about a rotational axis 65 and it is arranged to occlude the passage of the cooling air in a manner that is proportional to the angular position of said occlusion member 64 about the rotational axis 65. In other terms, the occlusion member is angularly movable between an angular position of minimum flow section and an angular position of maximum flow section. For example, the occlusion member 64 is configured as a planar circular sector having a vertex that is hinged about said rotational axis 65.

In accordance with an embodiment, the second flow rate variator device 61 comprises an indicator device suitable to indicate a second set value of said second flow rate variator device 61.

In accordance with an embodiment, the indicator device 24 comprises a reference scale and a pointer member indicating on said reference scale said second set value.

In accordance with an embodiment, the second flow rate variator device 61 comprises a second actuation device to move such occlusion member 64 in a position corresponding to said second set value corresponding to a desired cooling air flow rate value.

In accordance with an embodiment, the second actuation device is of the manual type, for example the actuation device is a projection of said occlusion member 64, manually displaceable by an operator.

In accordance with an embodiment, the second actuation device is of the motorized type, for example, it comprises a rotary actuator mounted to bring in rotation the occlusion member 64 between a maximum flow rate position and a position of minimum cooling air flow rate, for example, said actuation device is an electric motor.

In accordance with an embodiment, the second flow rate variator device 61 comprises an occlusion member position sensor 64.

In accordance with an embodiment, the occlusion member 64 is slidably constrained with respect to the heater.

In accordance with an embodiment, the reference device 40 is configured to suggest a second optimal setting value to set the second flow rate variator device 61, as a function of a pair of values formed by a value of said plurality of reference values of a parameter representative of the pressure 42 and a value of said plurality of reference temperature values 43.

In accordance with an embodiment, the heater comprises a second reference device, for example a second reference table, comprising a plurality of reference values of a parameter representative of the pressure 42, and a plurality of reference temperature values 43 of the air upstream of the combustion chamber 2, said reference device suggesting a second optimal setting value to set the second flow rate variator 61, as a function of each pair of reference values formed by a value of said plurality of reference temperature values 42 and a value of said plurality of reference values of a parameter representative of the pressure 43.

In accordance with an embodiment, said second reference device is integrated with the first reference device 40, to suggest an optimal setting value 41 to set the flow rate variator device 20 and a second optimal setting value to set the second flow rate variator device 61, as a function of the value of a reference parameter of representative of the pressure 41 and the value of the reference temperature 42 of the air upstream of the combustion chamber.

For example the second reference table is integrated with said first reference table 40, in which a setting value for the oxidizing air flow rate variator device 20 and a second setting value for the second cooling air flow rate variator device 60 corresponds to each pair of reference values formed by a reference temperature value 42 and a reference value of a parameter representative of the pressure 43 of the air upstream of the combustion chamber 2.

In this manner, the operator can manually actuate and visually control the heater 1, as regards both the oxidizing air flow rate and the cooling air flow rate.

In other terms, the operator can identify on the second reference table an optimal setting value to set the second cooling air flow rate variator device 61 corresponding to said reference temperature value 42 that is the nearest to the measured value and said reference value of a parameter representative of the pressure 43 that is the nearest to the measured value; and to actuate said second flow rate variator device 61 in accordance with said second optimal setting value.

In accordance with an embodiment, the control unit 80 is further connected to said second flow rate variator device 61 and is configured to vary the flow rate of the cooling air flow 11 as a function of said temperature value 42 and of said value representative of the pressure 43 of the air upstream of the combustion chamber 2, particularly in accordance with the second setting value.

In accordance with an embodiment, the second reference device comprises a memory unit associated to said control unit 80.

In this manner, the control unit 80 of the heater 1 is capable of automatically adjusting both the oxidizing air flow rate 11 and the cooling air flow rate 14 in an optimal manner, self-adjusting as the values of the external environmental parameters, such as environmental pressure and environmental temperature, or air density, change.

The heater 1 according to the invention is a fluid fuel, for example liquid fuel heater, particularly a diesel oil, or kerosene, or gasoline.

The supply duct 3 has a free end connected or connectable to a reservoir containing such liquid fuel.

Along such supply duct a hydraulic supply pump 7 can be present.

In accordance with an embodiment, the supply duct 3 comprises at least two separate dispensing nozzles 3', 3", by which the duct opens into the combustion chamber 2.

Particularly ad at least one of said dispensing nozzles 3', 3" is associated to corresponding opening/closure valve 3'", so as to open or close the fuel inflow through such dispensing nozzles 3', 3" in a selective manner, particularly as a function of said temperature value and said value representative of the air pressure measured upstream of the combustion chamber 2.

In this manner, it is possible to change the fuel flow rate in the combustion chamber simply by actuating one or more of the e above-mentioned opening/closure valves.

In accordance with an embodiment, a corresponding opening/closure valve 3''' is associated to each dispensing nozzle 3', 3''. In this manner, it is possible to open or close each nozzle 3, 3' depending on the environmental conditions, particularly the air density, or the air pressure and temperature.

In accordance with an embodiment, the reference device 40 is configured to suggest an optimal number of nozzles to be concomitantly actuated as a function of a pair of reference values formed by a value of said plurality of reference temperature values 43 and a value of said plurality of reference values of a parameter representative of the pressure 42.

In accordance with an embodiment, the heater 1 comprises a third reference device, for example a third reference table, comprising a plurality of reference values of a parameter representative of the pressure 42, and a plurality of reference temperature values 43 of the air upstream of the combustion chamber 2, said reference device suggesting an optimal number of nozzles to be concomitantly actuated as a function of each pair of reference values formed by a value of said plurality of reference temperature values 42 and a value of said plurality of reference values of a parameter representative of the pressure 43.

The third reference device can be integrated with the reference device 40 and/or with the second reference device. In this manner, the third reference device associates to each pair of reference values formed by a reference temperature value 42 and a reference value of a parameter representative of the pressure 43 of the air upstream of the combustion chamber 2, a corresponding setting value for the oxidizing air flow rate variator device 20, and a second setting value for the second cooling air flow rate variator device 60, and an optimal number of nozzles to be concomitantly actuated.

The third reference table can be integrated with the oxidizing air reference table 40 and/or with the second cooling air reference table.

In accordance with an embodiment, in such integrated reference table, a setting value for the oxidizing air flow rate variator device 20 and a second setting value for the second cooling air flow rate variator device 60, and an optimal number of nozzles to be concomitantly actuated corresponds to each pair of reference values formed by a reference temperature value 42 and a reference value of a parameter representative of the pressure 43 of the air upstream of the combustion chamber 2.

In other terms, the operator can identify on the third reference table an optimal number of nozzles to be concomitantly actuated corresponding to said selected reference temperature value 42 and to said selected reference value of a parameter representative of the pressure 43, and to open a number of opening/closure valves equal to the identified optimal number of nozzles to be actuated.

In this manner, the operator can manually operate and control also the fuel flow rate in the combustion chamber as a function of the external environmental conditions.

In accordance with an embodiment, said or each opening/closure valve is an electrovalve. In other terms, said or each opening/closure valve can comprise an actuation device of the electromagnetic type.

In accordance with an embodiment, the control unit 80 is connected to each electrovalve.

In accordance with an embodiment, the control unit 80 is configured to suggest, particularly by the third reference device, an optimal number of nozzles to be actuated corresponding to said preset nearest reference temperature value 42 and to said preset nearest pressure reference value 43.

In accordance with an embodiment, the control unit 80 is configured to open a number of opening/closure valves equal to the identified optimal number of nozzles to be actuated.

In accordance with an embodiment, the third reference device comprises a memory unit associated to said control unit 80.

In accordance with an embodiment, the heater 1 according to the invention comprises an output temperature sensor 86 arranged to measure the temperature of the cooling air 14 exiting the annular interspace 5. For example, the output temperature sensor 86 is in thermal contact with the outer mantle 4, particularly arranged in proximity of the output opening 5'' of the annular interspace 5.

The output temperature sensor 86 is connected with the control unit 80 to provide to the control unit 80 an electric signal depending on the temperature of the cooling air exiting the interspace 5.

The control unit 80 is configured to actuate the opening/closure valves so as to actuate a number of nozzles 3', 3'', such as to keep the temperature detected by the output temperature sensor 86 operatively below a preset maximum temperature threshold, particularly the control unit 80 is configured to keep the temperature detected by the output temperature sensor 86 operatively within a temperature range ranging between a preset minimum temperature and said preset maximum temperature.

In accordance with an embodiment, the heater 1 according to the invention is mounted on a cart 100 supported by wheels 101 and can be dragged by a transport means, for example, on road.

According to an aspect of the invention, the above-mentioned objects and advantages are met by a motorized or dragged vehicle comprising at least one heater 1 as described above.

Particularly, such vehicle can comprise a liquid fuel reservoir to supply said at least one heater.

For example, such vehicle can comprise a casing or carter containing said at least one heater.

The heater, which has been described above from the viewpoint of its technical characteristics, will be now described from the viewpoint of a method to actuate it.

Method for operating a fluid fuel heater 1 to heat air and to introduce it into an environment to be heated, as described above, comprising the steps of:

- associating to each value of a plurality of reference air pressure values 42 and to each value of a plurality of reference air temperature values 43, a corresponding optimal setting value 41 to actuate said flow rate variator device 20;
- measuring a temperature value and a pressure value of the air upstream of the combustion chamber 2 obtaining a measured pressure value and a measured temperature value;
- comparing said measured pressure value with the plurality of reference pressure values 43 and selecting the pressure reference value that is the nearest to the measured pressure value;
- comparing said measured temperature value with said plurality of reference temperature values 42 and selecting the reference temperature value that is the nearest to the measured temperature value;
- selecting an optimal setting value 41 corresponding to said nearest reference temperature value 42 and to said nearest reference pressure value 43;
- actuating said flow rate variator device 20 according to said optimal setting value 41.

In accordance with an embodiment, in the case that the heater further comprises:

a mantle 4 laterally wrapping the combustion chamber 2 forming an annular interspace 5 between the combustion chamber 2 and the mantle 4;

a second forced ventilation device 60 suitable to input a cooling air flow 14 into said interspace 5, so that said cooling air externally skims the combustion chamber 2 running through said interspace 5, subtracting heat to the combustion chamber 2 and concomitantly heating to heat the external environment downstream of the combustion chamber 2;

a second flow rate variator device 61 configured to vary the flow rate of said cooling air flow 14 in input to said interspace 5, between a minimum value and a maximum value; the above-mentioned method comprises the steps of:

associating to each value of a plurality of reference pressure values 42 and to each value of a plurality of reference temperature values 43, a corresponding second optimal setting value to actuate said second flow rate variator device 61;

comparing the measured pressure value with the plurality of reference pressure values 43 and selecting the pressure reference value that is the nearest to the measured pressure value;

comparing the measured temperature value with said plurality of reference temperature values 42 and selecting the reference temperature value that is the nearest to the measured temperature value;

selecting between said second setting values an optimal setting value corresponding to said nearest reference temperature value 42 and to said nearest reference pressure value 43;

actuating said second flow rate variator device according to said second optimal setting value.

In accordance with an embodiment, in the case that said fuel supply duct 3 comprises at least two separate dispensing nozzles 3', 3" in which a corresponding opening/closure valve is associated to at least one of said at least two separate dispensing nozzles, so as to open or close the fuel inflow through said at least two dispensing nozzles 3', 3" in a selective manner;

the method further comprises the steps of:

associating to each value of a plurality of reference pressure values 42 and to each value of a plurality of reference temperature values 43, a corresponding optimal number of nozzles to be actuated;

comparing the measured pressure value with the plurality of reference pressure values 43 and selecting the pressure reference value that is the nearest to the measured pressure value;

comparing the measured temperature value with said plurality of reference temperature values 42 and selecting the reference temperature value that is the nearest to the measured temperature value;

selecting between said optimal numbers of nozzles to be actuated, an optimal number of nozzles to be actuated corresponding to said nearest reference temperature value 42 and to said nearest reference pressure value 43;

opening a number of opening/closure valves equal to the identified optimal number of nozzles to be actuated.

To the embodiments of the device described above, those skilled in the art, in order to meet contingent needs, will be able to make modifications, adaptations, and replacements of elements with functionally equivalent other ones, without anyhow departing from the scope of the following claims. Each of the characteristics described as belonging to a possible embodiment can be implemented independently from the other embodiments described.

What is claimed is:

1. A transportable fluid fuel heater to heat and introduce air into an environment to be heated, comprising:

a combustion chamber;

a fluid fuel supply duct arranged to dispense said fluid fuel into said combustion chamber, a forced ventilation device arranged to collect oxidizing air from the exterior of the heater and to introduce said oxidizing air into the combustion chamber, so that said oxidizing air can react with said fluid fuel to carry out a combustion in the combustion chamber;

a flow rate variator device configured to vary the oxidizing air flow rate introduced in the combustion chamber by said forced ventilation device, between a minimum flow rate value and a maximum flow rate value; said flow rate variator device being manually adjustable by a user; and a reference device comprising a plurality of reference values of a parameter representative of the pressure and a plurality of reference temperature values of the environmental air upstream of the combustion chamber;

a control unit configured to:

(i) compare a measured pressure value of air upstream of the combustion chamber with the plurality of reference pressure values and select the reference pressure value that is nearest to the measured pressure value, (ii) compare a measured temperature value of air upstream of the combustion chamber with the plurality of reference temperature values and select the reference temperature value that is nearest to the measured temperature value, (iii) select an optimal setting value corresponding to the nearest reference temperature value and to the nearest reference pressure value; and (iv) suggest, to the user, the optimal setting value for the user to manually set the flow rate variator device, thereby adjusting the flow rate of oxidizing air introduced into the combustion chamber between the minimum flow rate value and the maximum flow rate value in accordance with the optimal setting value, as a function of the measured pressure value and measured temperature value of the air upstream of the combustion chamber, in order to provide the optimal flow rate of oxidizing air as the air density changes.

2. The heater according to claim 1, wherein said reference device is a reference table which associates a corresponding said optimal setting value to said each pair of reference values.

3. The heater according to claim 1, comprising a measurement device suitable to measure the temperature and pressure of the air upstream of the combustion chamber, and suitable to display a measured value of said pressure and a measured value of said temperature, or suitable to provide in output an electric signal, said electric signal being representative of a measured value of said parameter representative of the pressure and a measured value of said temperature.

4. The heater according to claim 1, comprising:

a mantle that externally wraps the combustion chamber forming an annular interspace between the combustion chamber and the mantle;

a second forced ventilation device suitable to input a cooling air flow in said interspace, so that said cooling air externally skims the combustion chamber running through said interspace, subtracting heat from the combustion chamber and concomitantly heating to heat the external environment downstream of the combustion chamber;

a second flow rate variator device configured to vary the flow rate of said cooling air flow, between a minimum value and a maximum value; said second flow rate variator device being manually adjustable by the user;

wherein said control unit is configured to suggest to the user a second optimal setting value to manually set the second flow rate variator device as a function of a pair of values formed by one value of said plurality of reference values of a parameter representative of the pressure and one value of said plurality of reference temperature values in order to allow the user to manually adjust the second flow rate variator device according to said second optimal setting value suggested by said reference device.

5. The heater according to claim 4, wherein said second forced ventilation device comprises a fan actuated by a rotary actuator, and said second flow rate variator device comprises a speed control of said rotary actuator suitable to control the number of rotations of the actuator between a minimum value of rotations corresponding to a minimum flow rate value of the cooling air flow and a maximum value of rotations corresponding to a maximum flow rate value of the cooling air flow.

6. The heater according to claim 1, wherein said fuel supply duct comprises at least two separate dispensing nozzles, wherein a corresponding opening/closure valve is associated to at least one of said dispensing nozzles, so as to open or close the fuel inflow through the dispensing nozzles in a selective manner.

7. The heater according to claim 6, wherein said control unit is configured to suggest to the user an optimal number of nozzles to be concomitantly actuated as a function of a pair of reference values formed by one value of said plurality of reference temperature values and one value of said plurality of reference values of a parameter representative of the pressure in order to allow the user to manually operate a number of nozzles according to the optimal number of nozzles suggested by the reference device.

8. A motorized or dragged vehicle comprising at least one heater according to claim 1.

* * * * *